US011365522B2

(12) United States Patent
Stocks

(10) Patent No.: US 11,365,522 B2
(45) Date of Patent: Jun. 21, 2022

(54) GRADING SYSTEM

(71) Applicant: SC Grade, LLC, Maple Grove, MN (US)

(72) Inventor: Bo Jason Stocks, Dixon, WY (US)

(73) Assignee: SC GRADE, LLC, Maple Grove, MN (US)

( * ) Notice: Subject to any disclaimer, the term of this patent is extended or adjusted under 35 U.S.C. 154(b) by 690 days.

(21) Appl. No.: 16/329,668

(22) PCT Filed: Mar. 21, 2018

(86) PCT No.: PCT/US2018/023515
§ 371 (c)(1),
(2) Date: Feb. 28, 2019

(87) PCT Pub. No.: WO2019/182582
PCT Pub. Date: Sep. 26, 2019

(65) Prior Publication Data

US 2021/0355647 A1 Nov. 18, 2021

(51) Int. Cl.
*E02D 3/032* (2006.01)
*E02F 3/78* (2006.01)

(52) U.S. Cl.
CPC ..... *E02D 3/032* (2013.01); *E02F 3/783* (2013.01)

(58) Field of Classification Search
CPC ..... E02F 3/783; E02F 3/76004
See application file for complete search history.

(56) References Cited

U.S. PATENT DOCUMENTS 3,779,408 A 12/1973 Ivie
3,878,952 A * 4/1975 Hueftle ..... E02F 3/402 414/697
4,185,698 A * 1/1980 Frisbee ..... E02F 3/7618 172/33
4,201,268 A 5/1980 Frisbee
4,281,721 A * 8/1981 Beales ..... E02F 3/8157 172/821
5,060,732 A * 10/1991 Baskett ..... A01B 43/00 171/63
5,261,218 A 11/1993 Jones et al.
(Continued)

OTHER PUBLICATIONS

International Search Report and Written Opinion for PCTUS2018023515 dated Jun. 18, 2018.
(Continued)

*Primary Examiner* — Jessica H Lutz
(74) *Attorney, Agent, or Firm* — Cook Alex Ltd.

(57) ABSTRACT

A grading system for connection to a vehicle having vertically movable arms, the grading system including a grading blade assembly having a frame having a first pivot extending upward, a second pivot extending forward, a blade connected to the frame via the first pivot and the second pivot, a blade yaw actuator and a blade roll actuator, wherein the frame is configured to have the first pivot extend substantially vertically and the second pivot extend substantially longitudinally when the grading blade assembly is connected to the vehicle and the blade and vehicle are in a level position on a ground surface and the vertically movable arms of the vehicle are in a first raised position above a lowest most position.

20 Claims, 14 Drawing Sheets

(56) References Cited

U.S. PATENT DOCUMENTS

| | | | | |
|---|---|---|---|---|
| 5,375,349 | A * | 12/1994 | Jochim | E01H 5/065 37/281 |
| 5,495,987 | A | 3/1996 | Slaby | |
| 5,901,911 | A | 5/1999 | Davis | |
| 6,056,066 | A * | 5/2000 | Wells | E02F 3/783 172/71 |
| 6,168,348 | B1 | 1/2001 | Meyer et al. | |
| 6,283,225 | B1 | 9/2001 | Hermonson | |
| 7,021,398 | B1 | 4/2006 | Marshall | |
| 8,118,111 | B2 * | 2/2012 | Armas | E02F 3/7618 172/779 |
| 9,328,479 | B1 | 5/2016 | Rausch et al. | |
| 9,730,372 | B2 * | 8/2017 | Campey | A01B 45/026 |
| 2002/0043009 | A1 | 4/2002 | Fulton, III | |
| 2002/0134559 | A1 | 9/2002 | Newnam | |
| 2003/0136568 | A1 | 7/2003 | McReynolds et al. | |
| 2005/0194161 | A1 * | 9/2005 | Tobin | E02F 3/7627 172/810 |
| 2005/0246926 | A1 | 11/2005 | Verseef | |
| 2006/0243463 | A1 | 11/2006 | Mensch | |

OTHER PUBLICATIONS

Publication, Blue Diamond, (https://www.bluediamondattachments.com) "Date unknown—admitted prior art."

* cited by examiner

GRADING SYSTEM

The present application is a National Stage of PCT International Application No. PCT/US2018/023515, filed Mar. 21, 2018 the disclosure of which is hereby incorporated herein by reference.

BACKGROUND

Field of the Invention

The present invention generally relates to earth moving equipment, and more particularly to a grading system for use on a vehicle.

Description of the Related Art

Earth moving equipment is available in different forms and for different purposes. Once excavation and concrete contractors have completed major work, which may include excavating and/or pouring a foundation for a structure, such as a commercial building or house, a dirt contractor works to build up or cut down the dirt pad or ground on the site, which may include the area around and inside of a structure. The dirt contractor is tasked with bringing the site to within 1/10 of a foot of the specifications on a grading site plan. Following the work by a dirt contractor, a fine grading contractor is brought in to move dirt and/or gravel with a goal in fine grading to achieve the highest quality slab and to keep the waste factor as little as possible. With known grading systems, this effort often results in finishing within 3/8" or 1/2" of the grading site plan.

It would be particularly advantageous to be able to use an automated grade control system on a fine grader, but typical skid steer vehicles and grading blade assemblies used for fine grading are not equipped to sufficiently control a blade to permit accurate automated control. There are some specialized grading systems that are capable of employing automation, but the structures unfortunately have undesirable bounce or instability of the grading system and little downward pressure, which results in very limited ground cutting ability and ultimately limits the ability to achieve the intended goal in fine grading. The limitations can be due to the extent to which a grading system extends forward from the vehicle, the use of forward support wheels and/or the mounting and controls, which typically include vertically movable arms on the vehicle and hydraulic actuators to control the pitch of a quick attach mounting plate.

It is common for a blade of a grading system to sit level with the tracks of a vehicle on a ground surface when the vertically movable arms of the vehicle are moved to a lowermost position against stops. However, in fine grading, it may be necessary to cut into the ground with a blade, such as when attempting to reduce the elevation of a surface, or to otherwise lower a blade when moving a pile of soil. To do so, the known vehicles that have a level blade with the vertically movable arms of a vehicle against a lower stop must use a pitch control on the vehicle to tilt the quick attach mounting plate forward so as to extend the lower edge of the grading blade below the height of the vehicle tracks, however, this causes the pivot axis of the grading blade to be significantly tilted, interfering with the ability to use a grading control system. There have been developments that include adding a stop bracket that is engaged by use of the hydraulic actuators that control the pitch of the quick attach mounting plate, but this only goes so far in trying to control the bounce introduced in a grading blade assembly where the blade is located well forward of the vehicle, the vehicle arms are still vertically movable, the quick attach mounting introduces undesirable movement, and the hydraulic actuators that control the pitch of the quick attach mounting plate can still bounce against the stop bracket.

In addition, there are times when a fine grading contractor may encounter areas of hard or solid ground, which may include highly compacted soil, frozen portions, concrete or asphalt debris, rocks or other matter. Such areas often require digging and removal by use of heavy duty digging equipment, followed by delivery of new soil to fill as needed because known grading systems are not capable of dealing with such solid ground variations or large chunks of hard dirt that may have been left by a dirt contractor. To date, fine grading systems are not equipped to deal with cutting such hard ground environments. Thus, existing fine grading systems include disadvantages that limit grading performance and that do not enable a fine grading assembly to work through hard ground without extensive intervention from other equipment.

SUMMARY

The present disclosure provides a grading system that permits a track vehicle to overcome major shortcomings in the prior art, in two ways. First, the grading system disclosed herein is able to utilize automated control, such as a 2 dimensional or 3 dimensional grading control system, while achieving far better performance including finishing within as little as 1/8" of the grading site plan. This is accomplished by having significantly less bounce as a result of improved stiffness. There are a few different contributing factors, including a grading blade assembly that extends a much shorter distance from the vehicle, elimination of the quick attach assembly, elimination of the pitch control actuators for the quick attach assembly, and a blade mounting configuration that permits the blade to be moved upward or downward while maintaining a substantially vertical pivot for the blade. The mounting configuration provides for connecting the grading blade assembly to a vehicle that does not include a quick attach assembly or pitch control actuators, while the blade is level and the blade and tracks of the vehicle are on level ground, and while the vertically movable arms of the vehicle are in a first raised position. The first raised position of the vertically movable arms of the vehicle may be, for example, a position that is a few inches, such as 5 inches, above the lower most stop position for the vertically movable arms. With the mounting configuration provided, this enables the grading system to maintain a substantially vertical pivot for the blade, thus keeping the blade level, when the blade is moved upward or downward by controlling only the vertically movable arms of the vehicle. The ability to maintain a substantially vertical pivot also enables the blade to remain level when introducing yaw movements, such as when turning the blade left or right, allowing for consistent machine control.

A second significant improvement over prior art grading systems is that the grading system disclosed may further include a cutting element assembly that is connected to the grading blade assembly. The combined grading blade assembly and cutting element assembly disclosed enable a fine grading system on a track vehicle, such as a skid steer, to avoid and/or consolidate significant steps that otherwise would follow the work of a dirt contractor. Rather than having to use heavy duty equipment to dig out and remove hard ground, debris or other such matter, back fill with new soil, the new grading system disclosed herein utilizes the cutting element assembly to cut and mulch the ground just forward of the blade in a manner sufficient to enable the soil to be fine graded by the very same vehicle. The lift actuator of the cutting element assembly is used to lift a cutting rotor to a raised position when not needed and to lower the rotor to a lowered position that together with the blade can extend below the track of the vehicle, if needed, so as to cut and mulch areas that present such hard ground or debris.

The new grading system presents a relatively mass efficient, compact structure that is mounted to the vertically movable arms at the front of a vehicle. The system facilitates articulation of the grading blade in yaw and roll, without the introduction of pitch movements from a quick attach assembly or the pitch control actuators that typically control the pitch of a quick attach assembly. In fact, the hydraulics for the pitch actuators that would have controlled the tilting of a bucket, for example, can instead be repurposed and connected to the roll actuator for roll control. The vehicle lift actuators for the vertically movable arms may be used to lift or lower the entire grading system, as necessary, while maintaining a substantially vertical pivot for the blade. The efficient, compact structure of the grading system has a relatively short distance between the front of the vehicle and the blade, and can be used with the optional cutting element assembly. Forward support wheels are not needed, permitting greater mobility and use of the new grading system closer to walls or other obstacles. The compact structure optionally also can be utilized in an adjustable system that mounts directly to the vertically moveable arms of the vehicle, or that mounts to a mounting interface that mounts to the vertically movable arms of the vehicle and provides greater vertical adjustment and some pre-selected pitch adjustment. The grading system provides tighter connections and an overall stiffer grading system that reduces the tendency of the blade to bounce or be jostled and stray from its intended path, as is critical for precise machine controlled grading. This enables the grading system to not only be used more effectively with automated control, but with the optional cutting element assembly, the grading system also can cut and mulch or pulverize hard ground and debris. Ultimately, this permits the grading system to more quickly and easily achieve the goal of providing a high quality slab, finishing the fine grading well within the required site plan specifications, while reducing the waste factor.

In a first aspect, the disclosure provides a grading system for connection to a vehicle having vertically movable arms. The grading system includes a grading blade assembly having a frame and a blade. The frame includes a first pivot extending upward between an upper member and a lower member, a second pivot extending forward between the upper member and the lower member, and a rearward facing mounting plate connected to the upper member and to the lower member. The blade includes a forward facing blade body having a lower edge, an upper edge and opposed ends, wherein the blade is connected to the frame via the first pivot and the second pivot. The grading blade assembly also includes a blade yaw actuator connected to the frame and to the blade, wherein the blade yaw actuator adjusts yaw movement of the blade relative to the first pivot, and a blade roll actuator connected to the frame and to the blade, wherein the blade roll actuator adjusts roll movement of the blade relative to the second pivot. The frame of the grading blade assembly is configured to have the first pivot extend substantially vertically and the second pivot extend substantially longitudinally when the grading blade assembly is connected to the vehicle and the blade and vehicle are in a level position on a ground surface and the vertically movable arms of the vehicle are in a first raised position above a lowest most position.

In a second aspect, the grading system of the disclosure optionally has the grading blade assembly include opposed end walls that are connected to and extend forward from the respective opposed ends of the blade, and further includes a cutting element assembly having a rotor including opposed ends, and cutting teeth connected to the rotor and having respective cutting edges at an angle relative to an outer surface of the rotor so as to provide cutting in one rotational direction. The cutting element assembly also includes first and second arms with each arm having a distal end rotatably connected to one of the respective opposed ends of the rotor and a proximal end pivotally connected to one of the respective end walls that extend forward from the opposed ends of the blade. The cutting element assembly further includes at least one lift actuator having a first end pivotally connected to at least one of the arms at a location spaced from the pivotal connection of the arm to the respective end wall and having a second end pivotally connected to the grading blade assembly, wherein the arms of the cutting element assembly have at least one lowered position and at least one raised position, and a drive motor is rotatably coupled to the rotor.

In a third aspect, the disclosure provides a method of connecting a grading system to a vehicle having vertically movable arms including providing a grading system having a grading blade assembly, wherein the grading blade assembly has a frame including a first pivot extending upward between an upper member and a lower member, a second pivot extending forward between the upper member and the lower member, and a rearward facing mounting plate connected to the upper member and to the lower member, with a blade including a forward facing blade body having a lower edge, an upper edge and opposed ends, wherein the blade is connected to the frame via the first pivot and the second pivot. The grading blade assembly further includes a blade yaw actuator connected to the frame and to the blade, wherein the blade yaw actuator adjusts yaw movement of the blade relative to the first pivot, and a blade roll actuator connected to the frame and to the blade, wherein the blade roll actuator adjusts roll movement of the blade relative to the second pivot. The method also includes placing the vehicle and grading blade assembly on level ground, raising the vertically movable arms of the vehicle to a first raised position, connecting the rearward facing mounting plate of the grading blade assembly to the vertically movable arms of the vehicle in the first raised position, wherein the first pivot extends substantially vertically and the second pivot extends substantially longitudinally when the grading blade assembly is connected to the vehicle and the blade and vehicle are in a level position on a ground surface.

It is to be understood that both the foregoing general description and the following detailed description are exemplary and provided for purposes of explanation only, and are not restrictive of the subject matter claimed. Further features and objects of the present disclosure will become more fully apparent in the following description of the preferred embodiments and from the appended claims.

BRIEF DESCRIPTION OF THE DRAWINGS

In describing the preferred embodiments, reference is made to the accompanying drawing figures wherein like parts have like reference numerals, and wherein.

Figure 1:
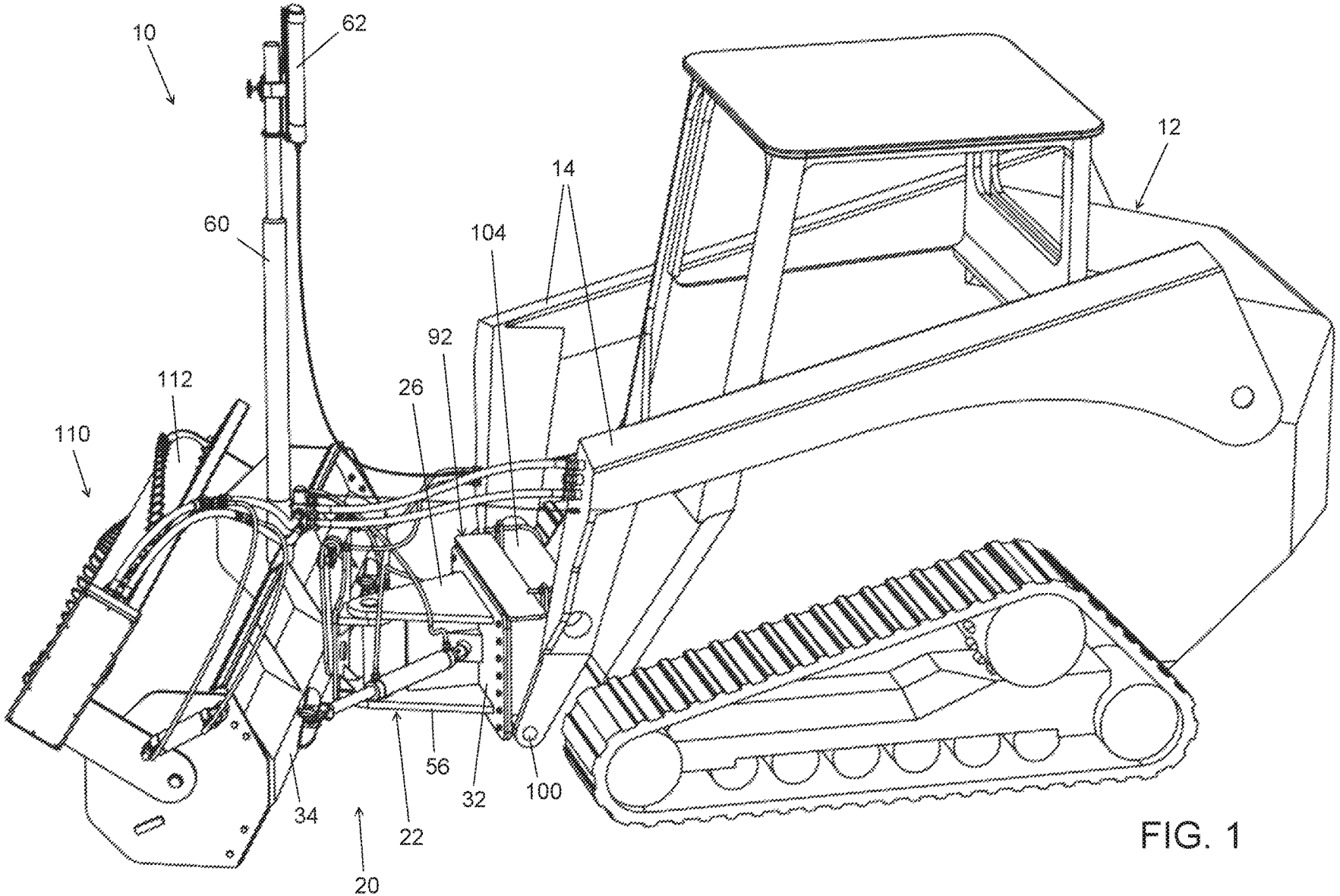
FIG. 1 is a left perspective view of a first example grading system installed on a vehicle.

It should be understood that the drawings are not to scale. While some mechanical details of the example grading system, including details of fastening means and other plan and section views of the particular components, have not been shown, such details are considered to be within the comprehension of those of ordinary skill in the art in light of the present disclosure. It also should be understood that the present disclosure and claims are not limited to the preferred embodiments illustrated.

DETAILED DESCRIPTION

Referring generally to FIGS. 1-13, it will be appreciated that grading systems of the present disclosure generally may be embodied in numerous configurations. Indeed, the teachings within this disclosure present embodiments that provide significant advantages over prior art grading systems, and in some instances with optional alternative structures.

FIGS. 1-12 show one or more variations of a first example embodiment of a grading system 10 for connection to a vehicle 12 having vertically movable arms 14. The vehicle 12 preferably is constructed as a track vehicle, such as a skid steer vehicle that may be available from a number of different manufacturers of commercial construction equipment. It will be appreciated that the grading system 10 may be mounted on a wheeled vehicle, although this would not be quite as desirable as mounting on a track vehicle, because a wheeled vehicle generally would not be steady on the ground as a track vehicle.

The grading system 10 shown in FIGS. 1-12 includes at least a grading blade assembly 20. The grading blade assembly 20 has a frame 22 having a first pivot 24 extending upward between an upper member 26 and a lower member 28, and a second pivot 30 extending forward from between the upper member 26 and lower member 28, and a rearward facing mounting plate 32 connected to the upper member 26 and lower member 28. The grading blade assembly 20 also includes a blade 34 including a forward facing blade body 36 having a lower edge 38, an upper edge 40 and opposed ends 42, 44. The blade 34 is connected to the frame 22 via the first pivot 24 and second pivot 30 to permit yaw and roll movements. These connections may be made in any suitable manner, such as by use of different types of pivot pins, axles, journaled couplings, bushings, bearings, or the like.

The grading blade assembly 20 of the grading system 10 further includes at least one blade yaw actuator 48 connected to the frame 22 and to the blade 34. The blade yaw actuator 48 adjusts yaw movement of the blade 34 relative to the first pivot 24. The grading blade assembly 20 also includes a blade roll actuator 50 connected to the frame 22 and to the blade 34. The blade roll actuator 50 adjusts roll movement of the blade 34 relative to the second pivot 30. The frame 22 of the grading blade assembly 20 is configured to have the first pivot 24 extend substantially vertically and the second pivot 30 extend substantially longitudinally, relative to a longitudinal axis of the vehicle, when the grading blade assembly 20 is connected to the vehicle 12 and the blade 34 and vehicle 12 are in a level position on a ground surface and the vertically movable arms 14 of the vehicle 12 are in a first raised position above a lowest most position. It will be understood that the longitudinal extension of the second pivot 30 is relative to the orientation of the vehicle 12. With the mounting configuration provided, this enables the grading system to maintain a substantially vertical first pivot 24 for the blade 34, thus keeping the blade 34 level, when the blade 34 is moved upward or downward by controlling the vertically movable arms 14 of the vehicle 12. The ability to maintain a substantially vertical first pivot 24 also enables the blade 34 to remain level when introducing yaw movements, such as when turning the blade 34 left to right.

It will be appreciated that the blade yaw actuator 48 and blade roll actuator 50 may be hydraulic actuators. The blade yaw actuator 48 is connected at a first end 48*a* to the blade 34 at a location spaced laterally from the first pivot 24 toward one of the ends 42, 44 of the blade 34 and connected at a second end 48*b* to the frame 22 at a location rearward of the first pivot 24. The blade yaw actuator 48 provides for yaw movements or turning of the blade 34, such as may be seen with respect to a partial turn to the right in FIG. 1 and to the left in FIG. 10. The yaw angle achieved may depend on the final configuration of the grading system, but preferably the blade 34 may be turned in both directions at least 25-30 degrees. To provide firm angular positioning of the blade 34, the example grading blade assembly 20 further includes a second blade yaw actuator 52 connected at a first end 52*a* to the blade 34 at a location spaced laterally from the first pivot 24 toward the opposite one of the ends 42, 44 of the blade 34 and connected at a second end 52*b* to the frame 22 at a location rearward of the first pivot 24.

Figure 5:
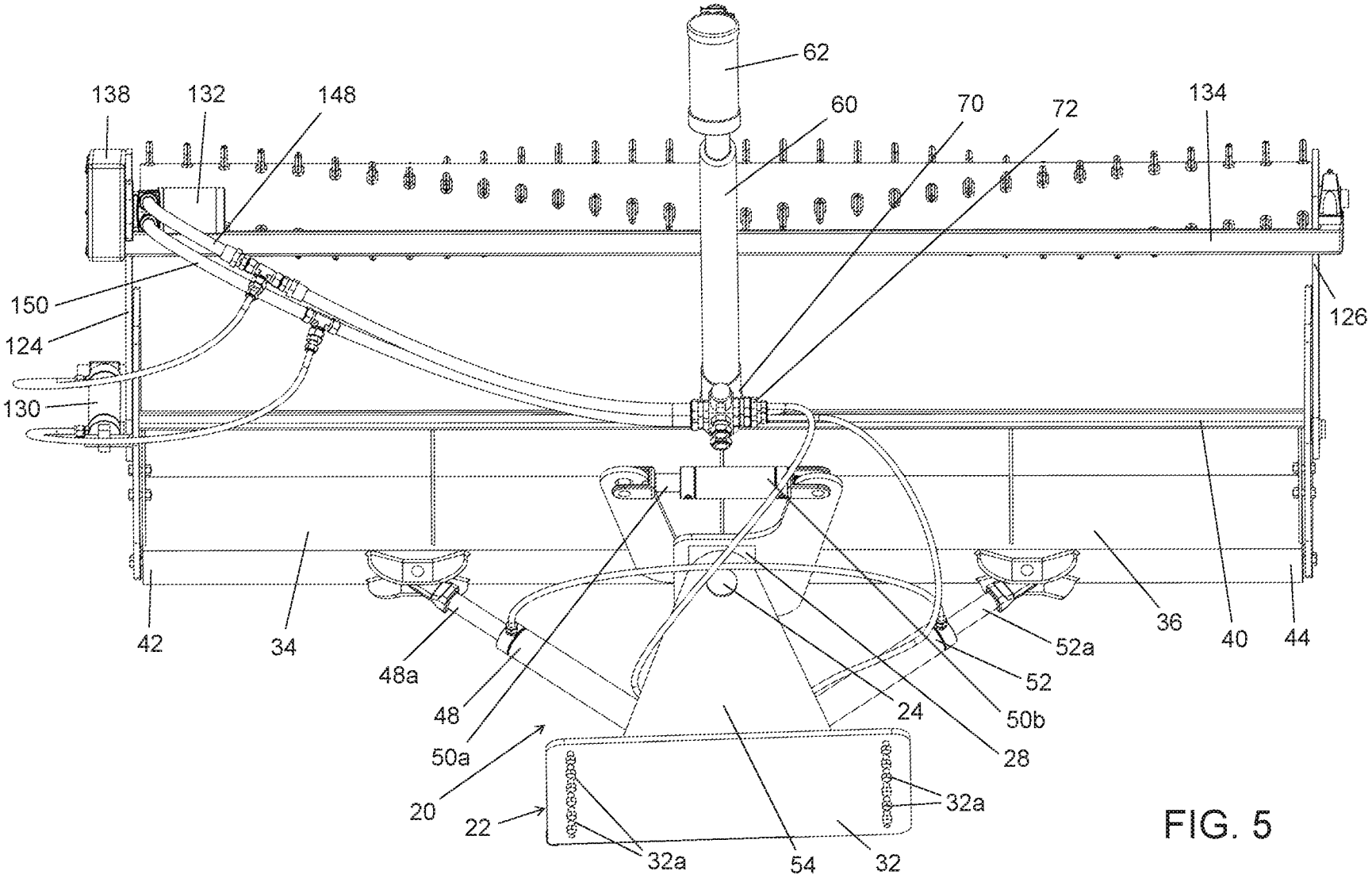
FIG. 5 is a top rear perspective view of the grading blade assembly of the example grading system shown in FIG. 1.
Figure 6:
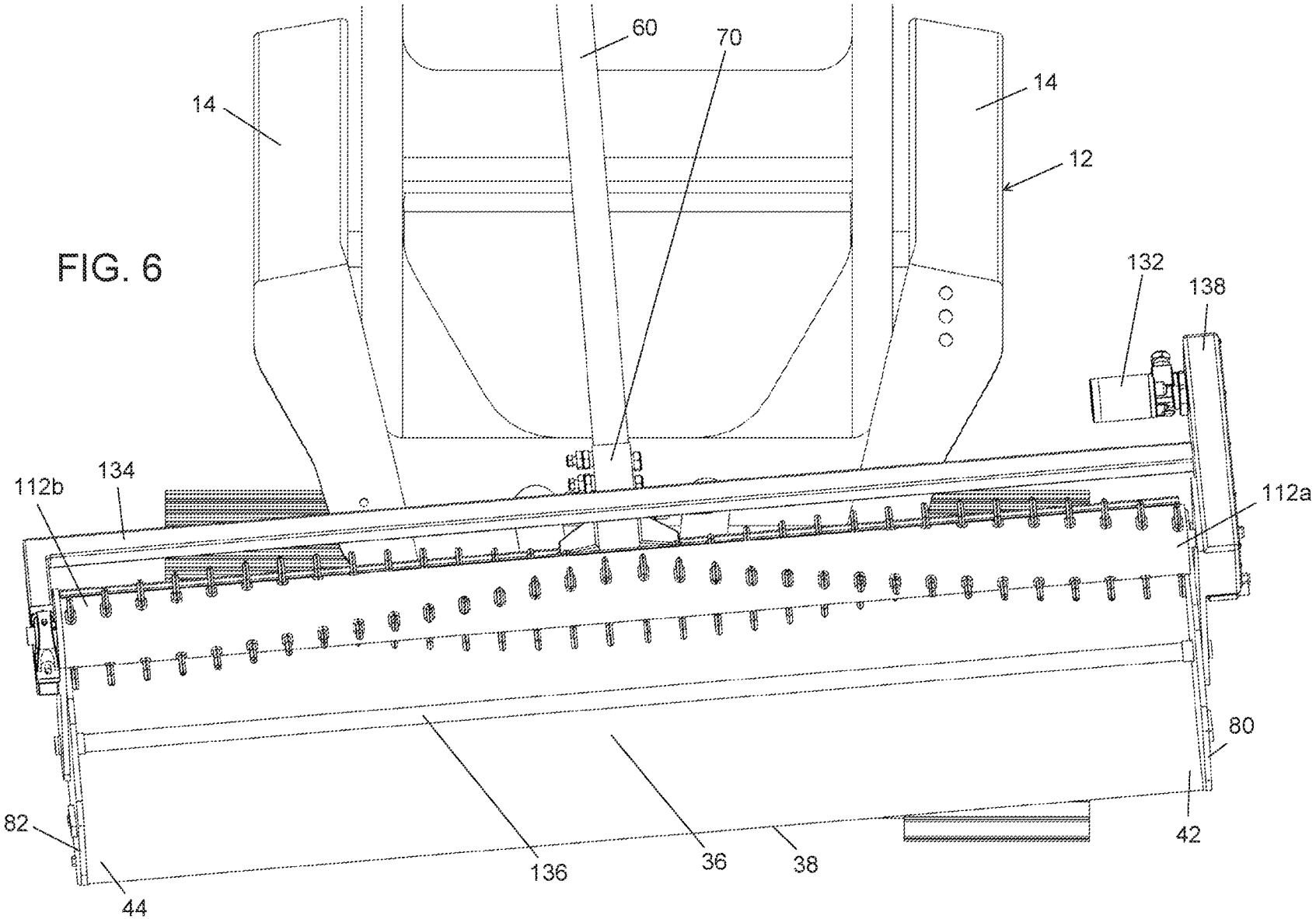
FIG. 6 is a front perspective view of the grading system shown in FIG. 1 and demonstrating a roll movement.
Figure 7:
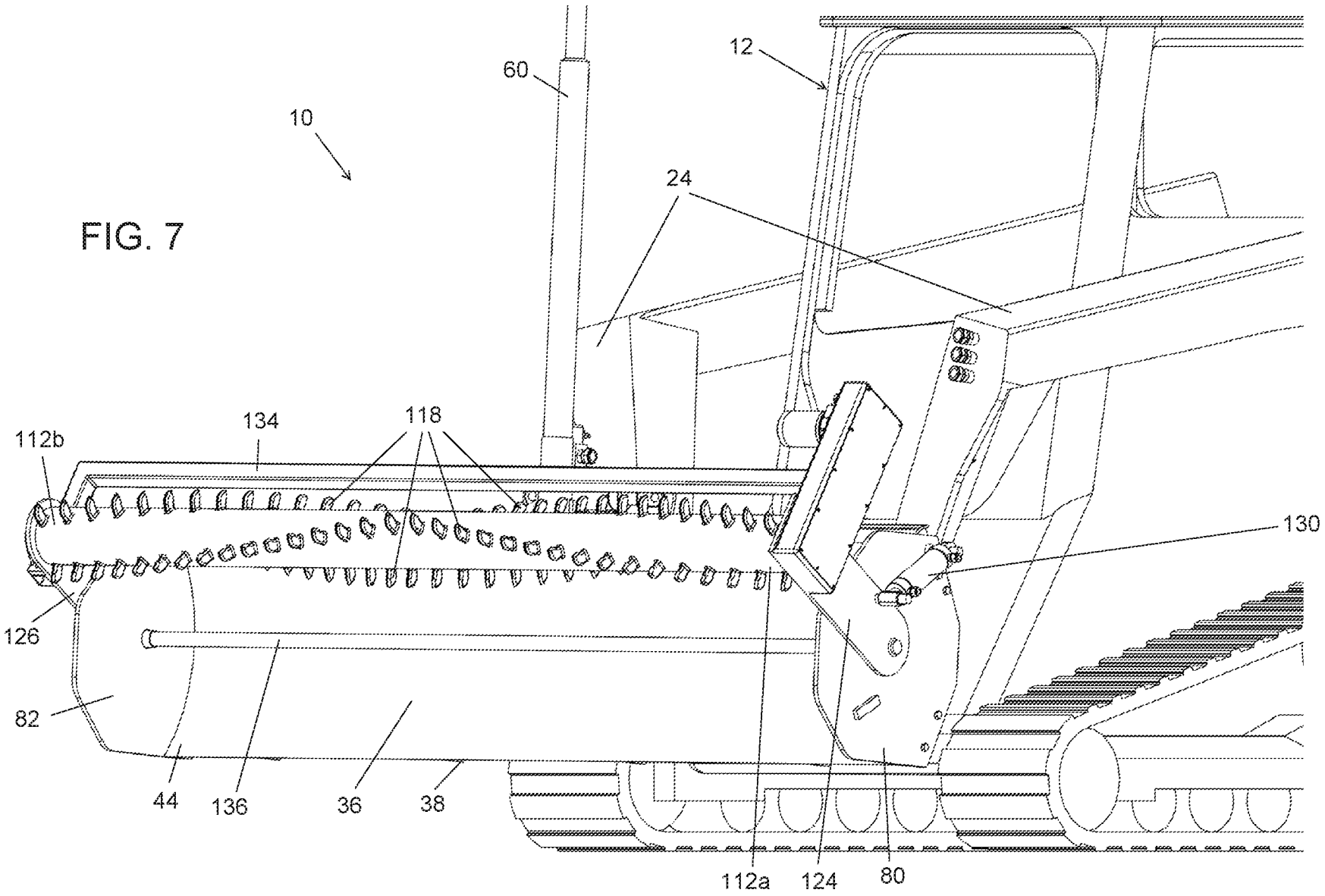
FIG. 7 is a left front perspective view of the example grading system shown in FIG. 1, with the grading system in a raised position.
Figure 8:
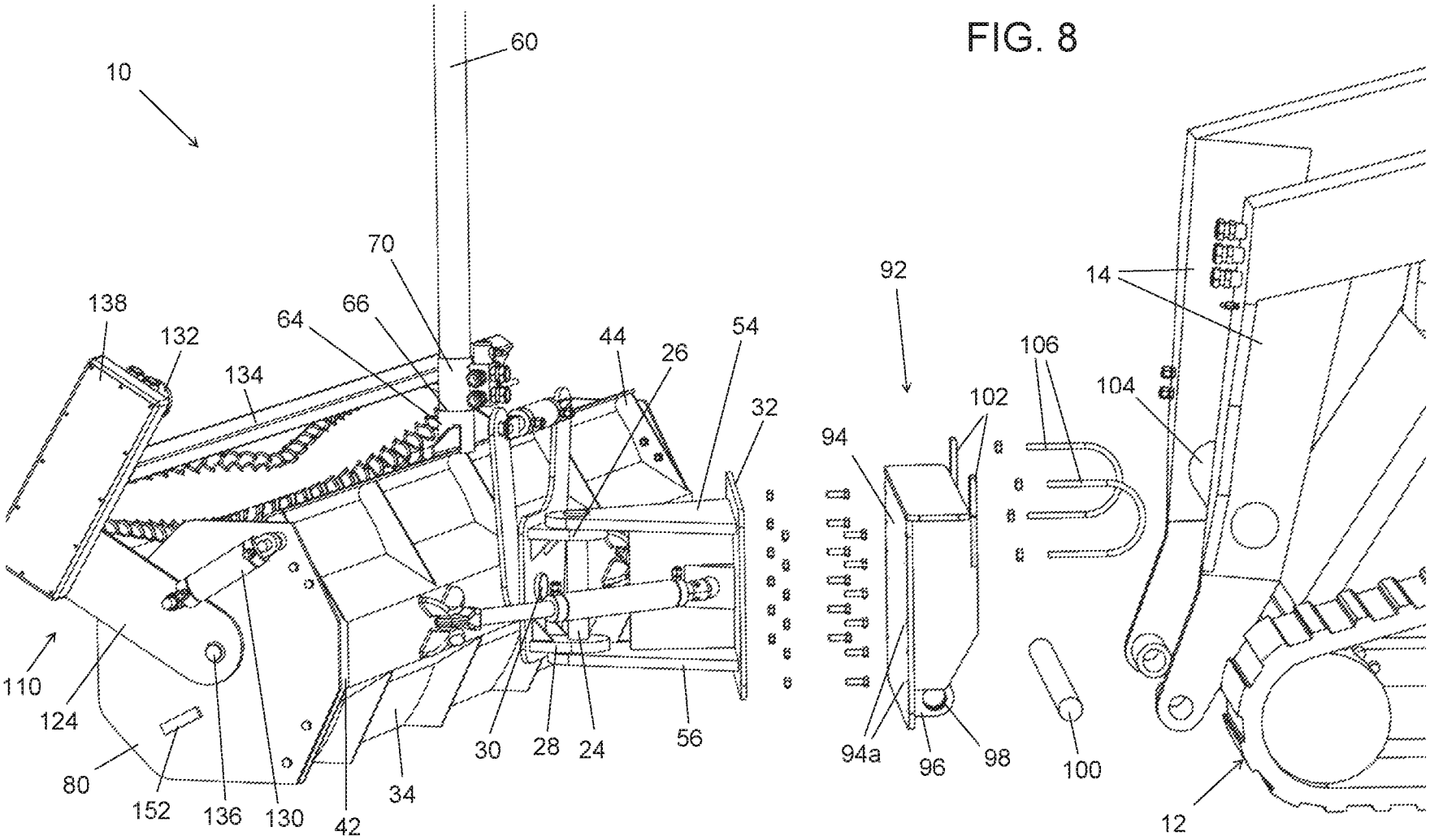
FIG. 8 is a partial exploded left perspective view of the example grading system shown in FIG. 1, with the grading blade assembly and cutting element assembly separated from the mounting interface, which in turn is separated from the vehicle.

In turn, as may be best seen in FIG. 5, the blade roll actuator 50 of this example is connected at a first end 50*a* to the blade 34 at a location spaced laterally from the first pivot 24 toward one of the ends 42 or 44 of the blade 34 and is connected at a second end 50*b* to the frame 22 at a location spaced vertically from the second pivot 30. The roll actuator 50 provides for roll movements of the blade 34, such as may be seen in FIG. 6. It will be appreciated, however, that the mounting and movement of the yaw and roll actuators may vary, as desired. As with the other actuators, the second blade yaw actuator 52 may be constructed as a hydraulic actuator. This is convenient, given that most vehicles 12 that are designed for use in construction already are equipped with a hydraulic system, which also may be used to raise or lower front arms 14 on the vehicle. Nevertheless, alternative actuators, such as electric linear or rotary hydraulic or electric actuators, or other suitable actuators may be configured to impart direct or coupled movement to the blade 34.

The example grading system 10 does not include a pitch actuator, which normally would be connected to a quick attach assembly that may be used to tilt a bucket accessory that would be attached to the quick attach assembly. Without the typical quick attach assembly and pitch actuator associated therewith, the rearward facing mounting plate 32 of the grading system 10 has a pre-selected pitch position that remains substantially the same within the normal range of movement of the vertically movable arms 14 of the vehicle 12 during grading. Also, the frame 22 further includes an upper extension member 54 and a lower extension member 56 that extend forward from the rearward facing mounting plate 32, and that are connected to the upper member 26 and lower member 28 via the first pivot 24.

The grading system 10 preferably includes a mast 60 that is connected to and extends upward from the grading blade assembly 20. The grading system 10 may be used with a laser guided or three dimensional grading control system. Thus, as shown in this example, an electronic component 62 of an automated grade control system, such as a laser receiver or a prism, may be connected to the mast 60. In the present example, a mast receiver 64 is connected to the grading blade assembly 20 and configured to removably receive the mast 60. For example, the mast receiver 64 includes an open tube that is connected to the upper edge 40 of the blade 34, such as be welding or fasteners, and it has an opening 66 to receive the mast 60. If desired, at least one set screw along the side wall of the mast receiver may be used to removably connect the mast 60 to the mast receiver 64, such as by applying a clamping load to the mast 60. Although, it will be appreciated that the mast 60 could be secured to the grading blade assembly 20 by other means of attachment.

Figure 2:
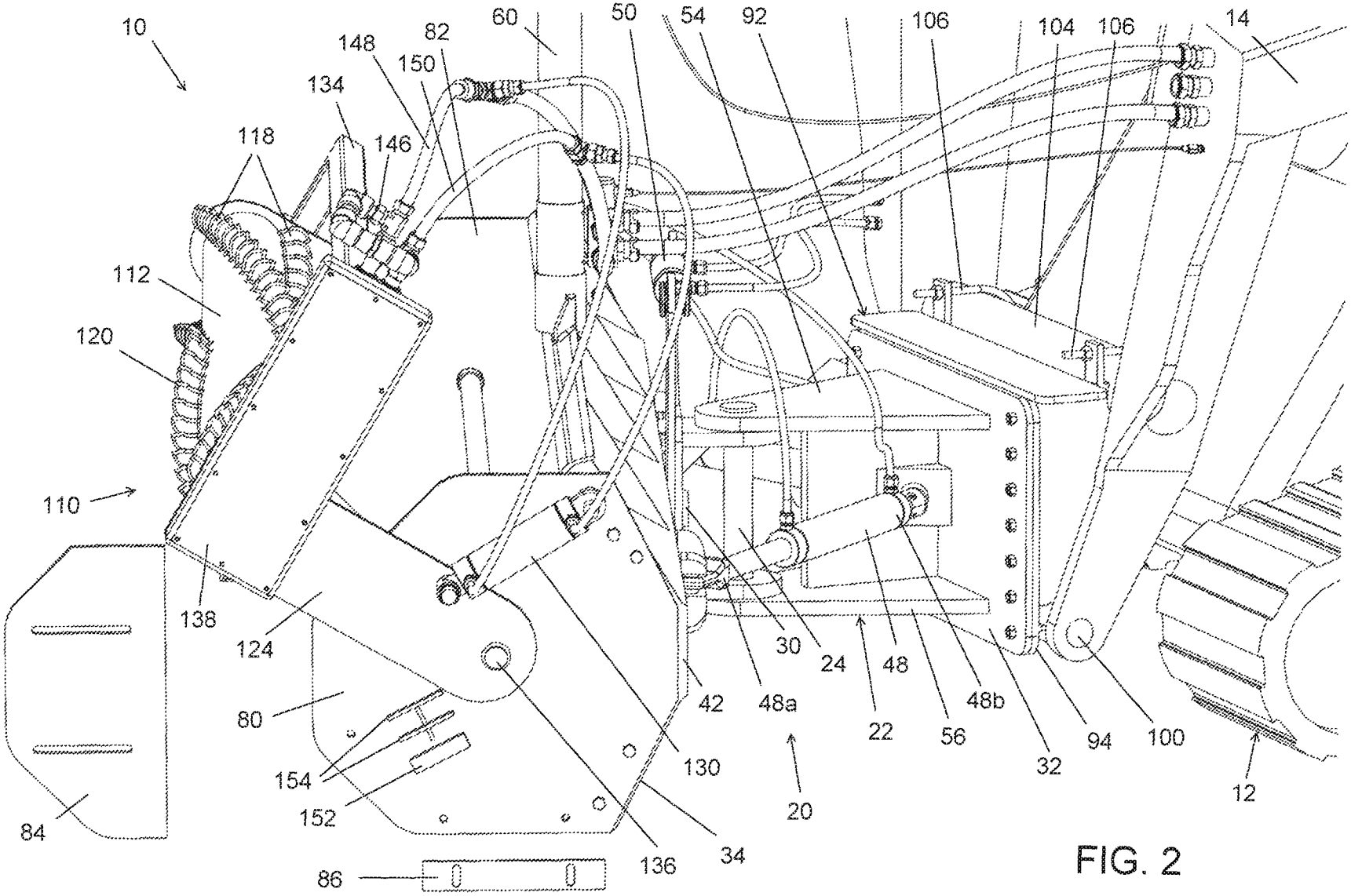
FIG. 2 is a closer left perspective view of the example grading system shown in FIG. 1, with a blade of a grading blade assembly demonstrating a yaw movement to the right and in a lowered position and a cutting element assembly in a raised position, and showing optional forward and downward extensions connected to the end walls of the blade.
Figure 3:
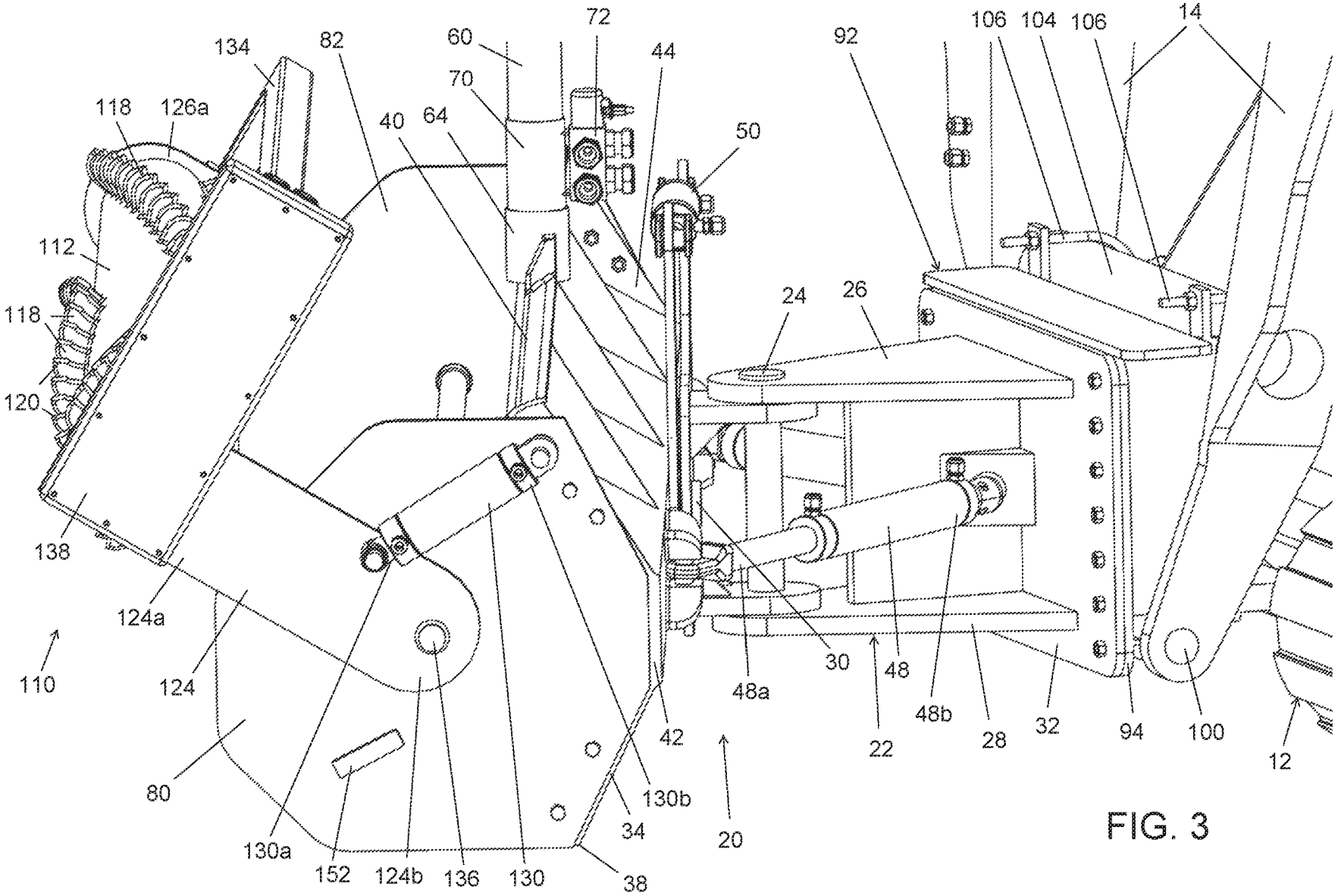
FIG. 3 is a closer left perspective view of the example grading system as shown in FIG. 2, with the hydraulic and electrical lines removed for ease of viewing and showing a closer view of the connection to a mounting interface that, in turn, is mounted to the vehicle.

The mast 60 also presents a convenient place to mount hydraulic components because it is well above the ground and in an area that is less susceptible to damage. However, because the mast 60 rotates during yaw adjustments relative to a longitudinal axis of the vehicle, hydraulic hoses may tend to be subjected to undesirable flexing events. To combat this in the example shown, as best seen in FIGS. 2, 3 and 5, a collar 70 is rotatably connected to the mast 60, and the collar 70 has at least one hydraulic component 72 connected to the collar 70, such that the hydraulic component 72 remains in a substantially longitudinal direction when the blade 34 is subjected to a yaw movement. For instance, the at least one hydraulic component 72 in the example is a valve body that includes a first circuit that controls the blade roll actuator 50 and a second circuit that controls the blade yaw actuators 48, 52. The hydraulic hoses connected to the valve body 72 are subjected to less flexing, due to the ability of the collar 70 to freely rotate around the mast 60, which causes the valve body 72 to stay in approximately the same orientation relative to the longitudinal axis of the vehicle 12.

The blade 34 of the grading blade assembly 20 may include opposed end walls 80, 82 that are connected to and extend forward from the respective opposed ends 42, 44 of the blade 34. As may be appreciated in FIG. 2, the end walls 80, 82 of the grading blade assembly 20 may include optional forward extensions 84 that are adjustable with respect to extending forward from the blade 34. These forward extensions 84 may be removed, installed and/or adjusted as desired with respect to controlling material ahead of the blade 34, and may be connected to the respective end walls 80, 82 by fasteners or other suitable means of connection. In a somewhat similar manner, the end walls 80, 82 of the grading blade assembly 20 also may include downward extensions 86 that are adjustable with respect to extending downward from the blade 34, and may be connected to the respective end walls 42, 44 by fasteners or other suitable means of connection. The downward extensions 86 permit adjustment of the height of the effective lower edge of the end walls 80, 82 relative to the lower edge 38 of the blade 34, as the lower edge 38 of the blade 34 wears. Thus, wear of the lower edge 38 of the blade 34 and of the downward extensions 86 may be checked and adjusted periodically as needed to maintain an appropriate lower boundary of the grading blade assembly 20.

When using the grading system 10, it is possible to operate the one or more blade yaw actuators 48, 52 to impart a yaw adjustment to the blade 34. This may permit an angular adjustment of the blade 34 of up to around 30 degrees, although this may differ as desired. When the blade 34 is positioned at an angle, if it did not include the end walls 80, 82, the material being moved by the blade 34 would tend to be discarded from the rearward raked edge of the blade 34. Accordingly, the end walls 80, 82 of the blade 34 may assist in keeping the graded material in front of the blade, which in turn may assist in filling low spots or otherwise redistributing the graded material. To help control the extent to which the blade 34 is able to capture the graded material, one or both of the end walls 80, 82 may be installed and may include a forward extension 84 and/or downward extension 86.

The grading system 10 is of a particularly efficient compact design that reduces the extent to which the system extends forward of the vehicle 12. This is facilitated, in part, by the frame 22 having a rearward facing mounting plate 32 that is fairly close to the blade 34. The rearward facing mounting plate 32 is connected to the upper member 26 and to the lower member 28. As noted above, these connections may further include upper extension member 54 and lower extension member 56 extending forward from the rearward facing mounting plate 32 and being connected to the upper member 26 and lower member 28 via the first pivot 24. Furthermore, the grading system 10 is connected to the vehicle 12 via the rearward facing mounting plate 32, in conjunction with a mounting assembly. In the first example, a mounting assembly 90 includes a mounting interface 92 that connects to the vehicle 12 and includes a forward facing mounting plate 94.

The mounting interface 92 is constructed with a particular configuration, so as to be able to be mounted to the particular type of vehicle shown. The mounting interface 92 shown in this example is best seen in FIGS. 3, 8 and 9A-9D. The mounting interface 92 includes rearward extending lower brackets 96 having passages 98 therethrough to accept pin 100 for connection to the end of the arms 14 of the vehicle 12, after a quick attach assembly has been removed from the vehicle 12, if it had been so equipped. The mounting interface 92 also includes rearward extending upper brackets 102 that are used to fix the position of the mounting interface 92 relative to the vertically movable arms 14 of the vehicle 12. In this example, the connection of the rearward extending upper brackets 102 to a cross member 104 that extends between and is connected to the vertically movable arms 14 of the vehicle 12. The connection is accomplished by use of fasteners 106 in the form of large U-shaped bolts with corresponding washers and nuts, as shown. It also will be appreciated that the mounting interface 92 is adjustable with respect to the angle of the forward facing mounting plate 94, such as by use of shims when connecting the U-shaped fasteners 106 to the rearward extending upper brackets 102 and the cross member 104 of the front arms 14 of the vehicle 12.

The mounting interface 92 may have other structural members that lend further stiffness and/or support to the rearward extending upper and lower brackets 102, 96, and it will be appreciated that alternative configurations and structures may be used to form a suitable mounting interface 92 to provide for secure mounting of the grading system 10 to the vehicle 12. Indeed, the actual configuration likely will differ depending on the particular structure of the vehicle to which the grading system is to be mounted In addition, the grading system 10 of the first example is height adjustable to a preselected degree relative to the vehicle 12 when resting on a ground surface, as well as by use of the vertically movable arms 14 of the vehicle 12. A pattern of vertically spaced apart holes 32*a* through the rearward facing mounting plate 32 of the frame 22, and a pattern of vertically spaced apart holes 94*a* in the forward facing mounting plate 94 of the mounting interface 92 make the frame 22 height adjustable relative to the forward facing mounting plate 94 of the mounting interface 92 that is connected to the front arms 14 of the vehicle 12. For instance, the holes through the respective mounting plates 32, 94 and use of suitable fasteners, such as bolts and nuts, may permit a range of height adjustment from for example 4 inches below the grade to 4 inches above the grade, without repositioning the vertically movable arms 14 of the vehicle 12. It will be appreciated that the range and intervals of adjustment may be constructed as desired and will be limited by the vertical extent of the respective mounting plates and the hole patterns.

Figure 9A:
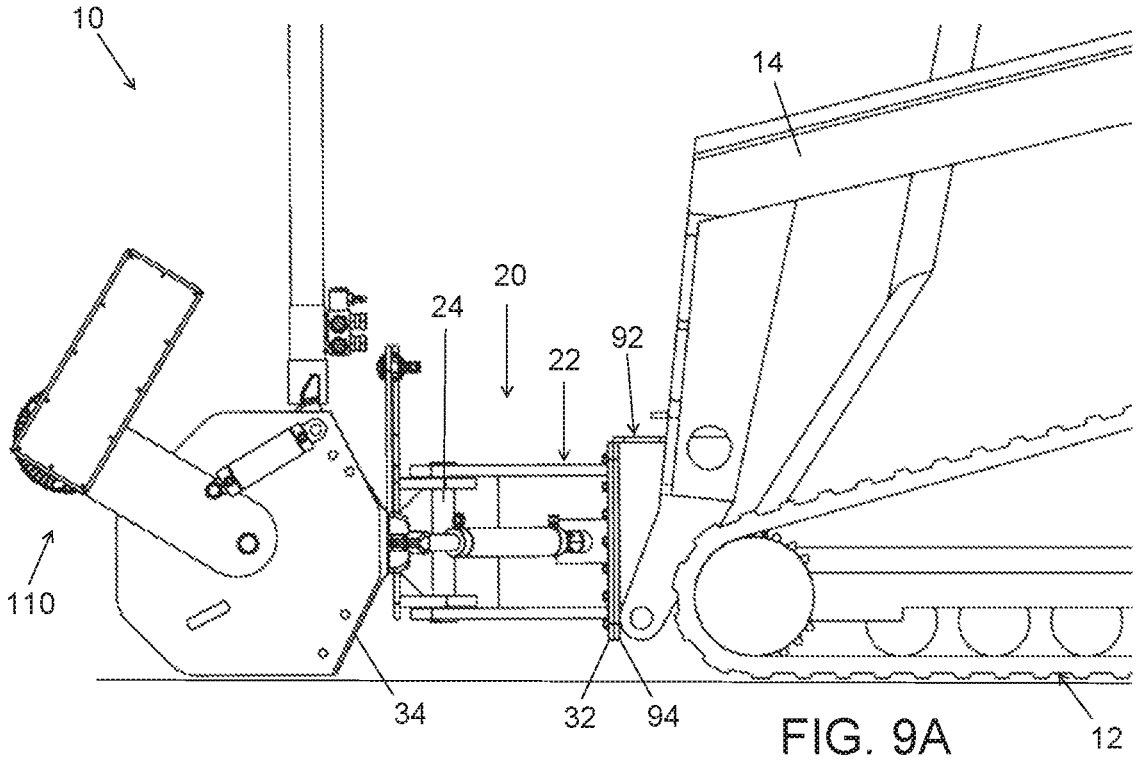
FIG. 9A is a simplified schematic side view of the grading system of FIG. 1, showing the unique positioning of components when the grading blade assembly and vehicle are resting on a ground surface.

FIGS. 9A-9D provide simplified schematic side views to help show a relative range of adjustment for the height of the blade 34 with respect to the positioning of the vertically movable arms 14 of the vehicle 12 and of the respective mounting plates 32, 94 of the grading blade assembly 20 and the mounting interface 92. In FIG. 9A, when initially connecting the grading blade assembly 20 to the vehicle 12, the vertically movable arms 14 of the vehicle 12 are raised to a position above a lowest most position. For example, depending on the needs for the day, the arms 14 may be raised to a position 4" or 5" above the lowest position. When the rearward facing mounting plated 32 of the grading blade assembly 20 is mated in a full overlap position to the forward facing mounting plate 94 of the mounting interface 92, the blade 34 rests on the ground with the vehicle 12 and the first pivot 24 is substantially vertical, while the second pivot 30 is substantially longitudinal.

Figure 9B:
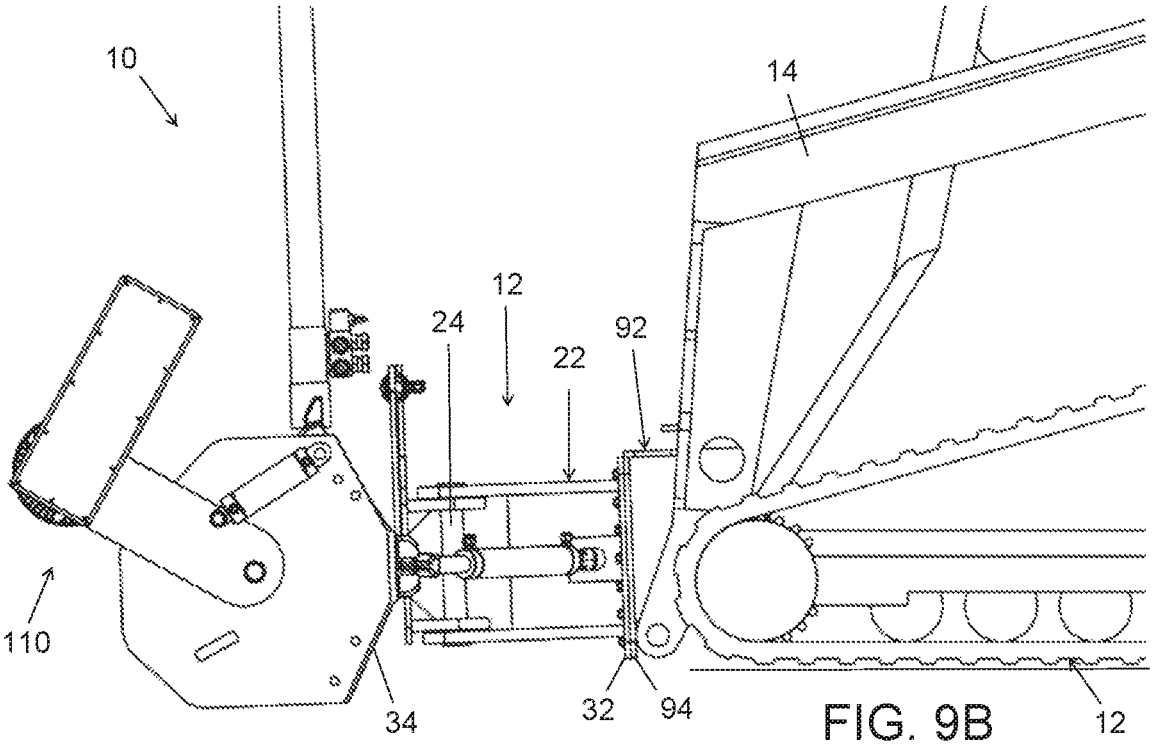
FIG. 9B is a simplified schematic side view similar to FIG. 9A but showing the relative positioning of components when the vehicle is resting on a ground surface and the vertically movable arms of the vehicle have been moved to a lowermost position, resulting in the grading blade assembly being below the vehicle.
Figure 9C:
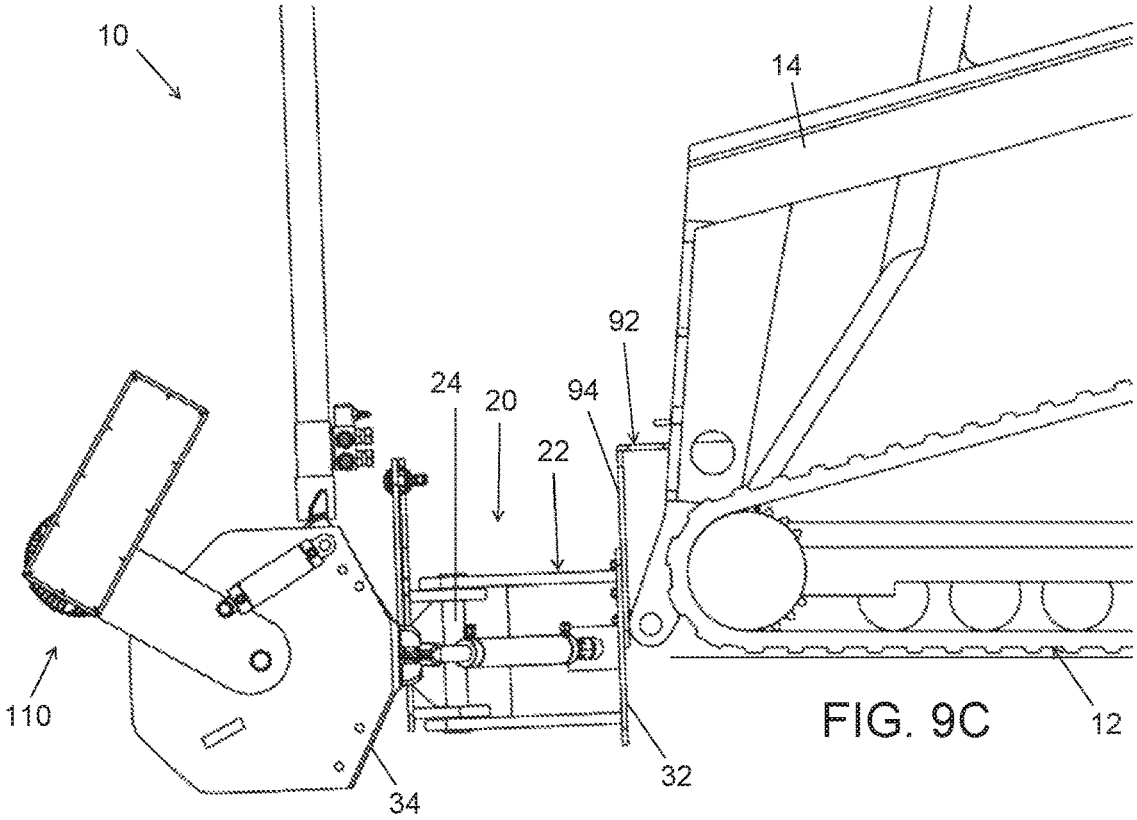
FIG. 9C is a simplified schematic side view similar to FIG. 9B but showing the relative positioning of components when the vehicle is resting on a ground surface and the vertically movable arms of the vehicle have been moved to a lowermost position and the adjustable mounting has been moved downward, resulting in the grading blade assembly being further below the vehicle.
Figure 9D:
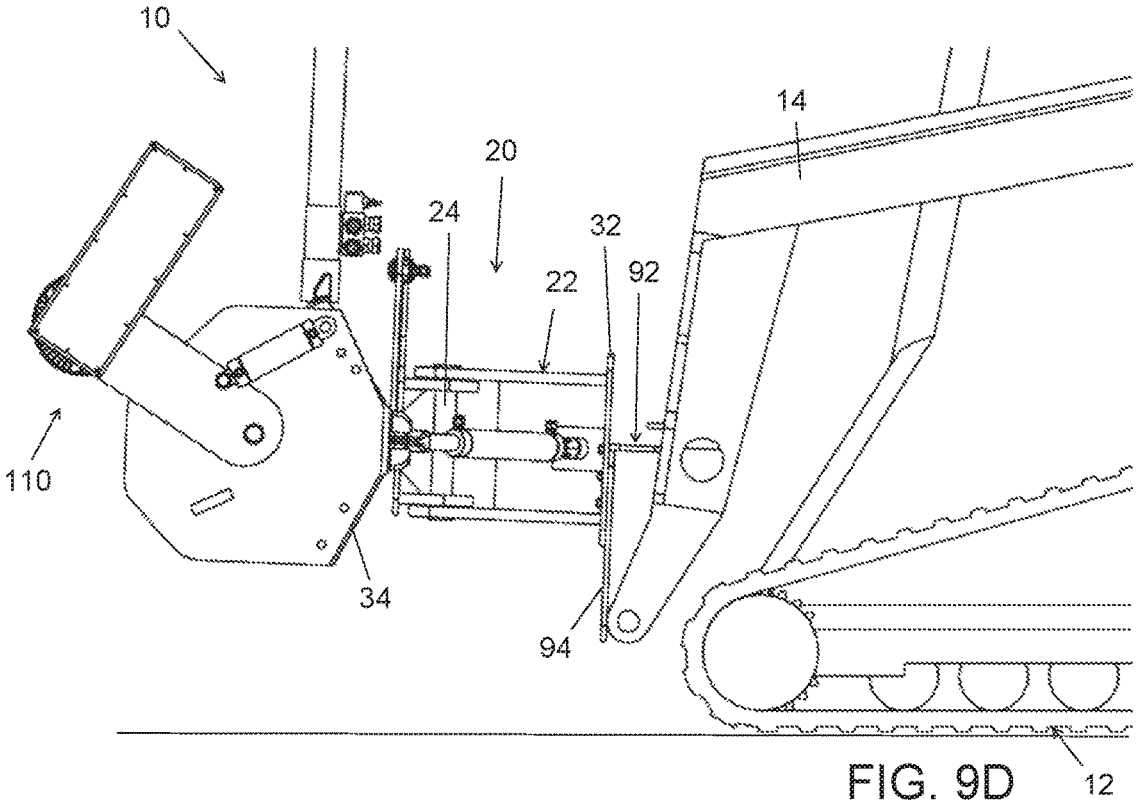
FIG. 9D is a simplified schematic side view similar to FIG. 9A but showing the relative positioning of components when the vehicle is resting on a ground surface and the vertically movable arms of the vehicle have been raised further and the adjustable mounting has been moved upward, resulting in the grading blade assembly being above the vehicle.
Figure 10:
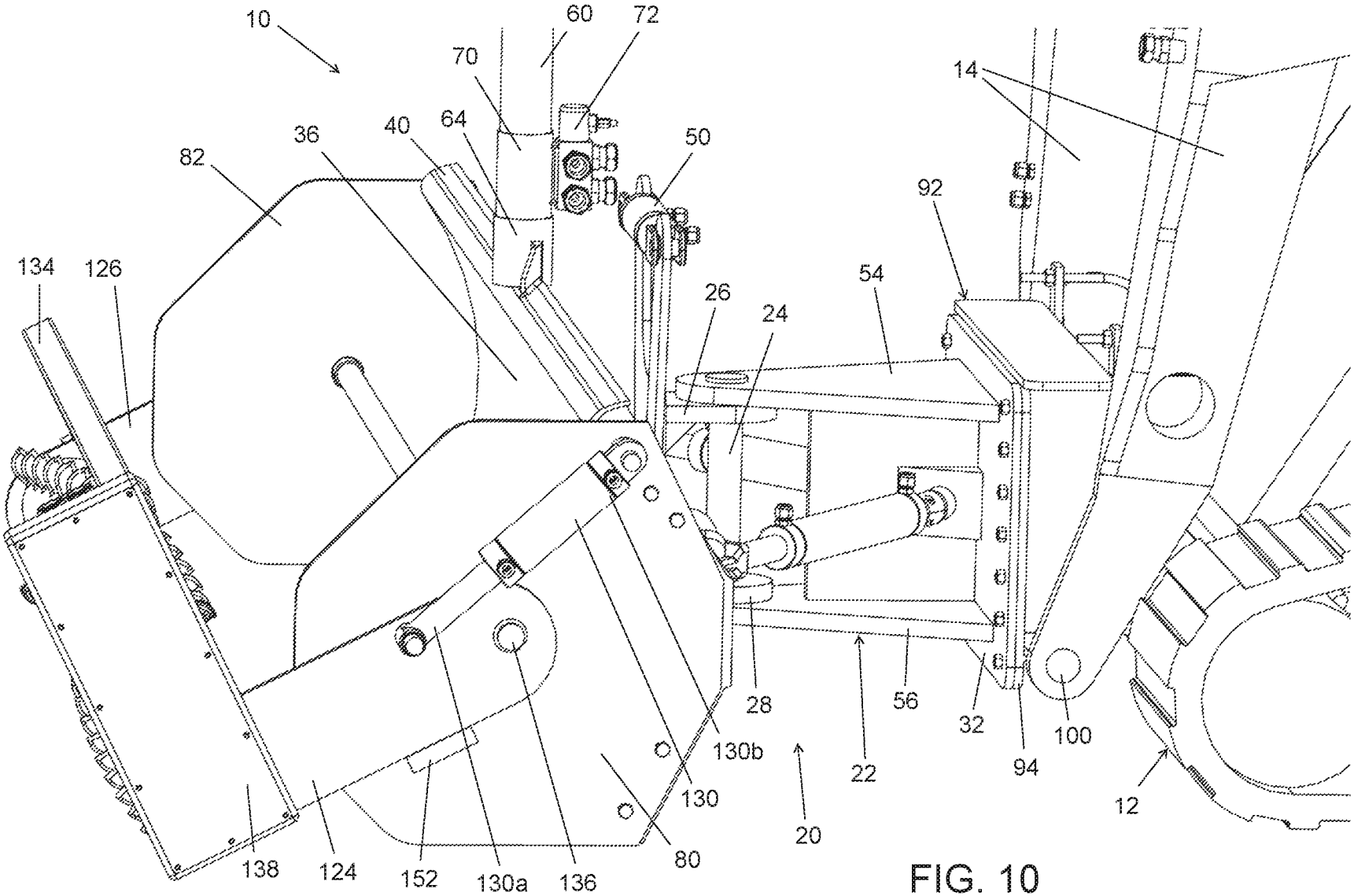
FIG. 10 is a closer left perspective view of the example grading system shown in FIG. 1, with the cutting element assembly in a lowered position.
Figure 11:
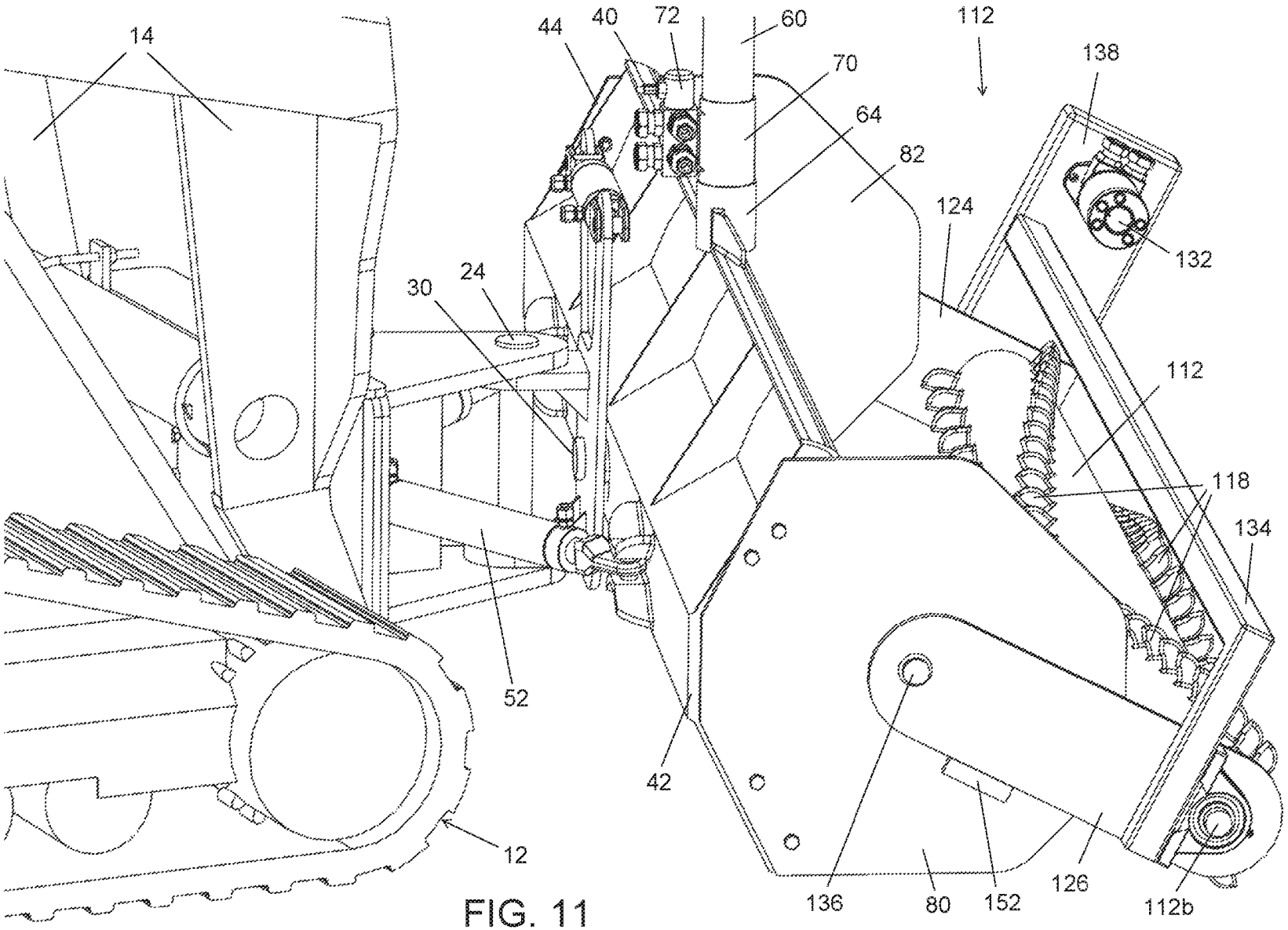
FIG. 11 is a closer right perspective view of the example grading system shown in FIG. 1, with the cutting element assembly in a lowered position.
Figure 12:
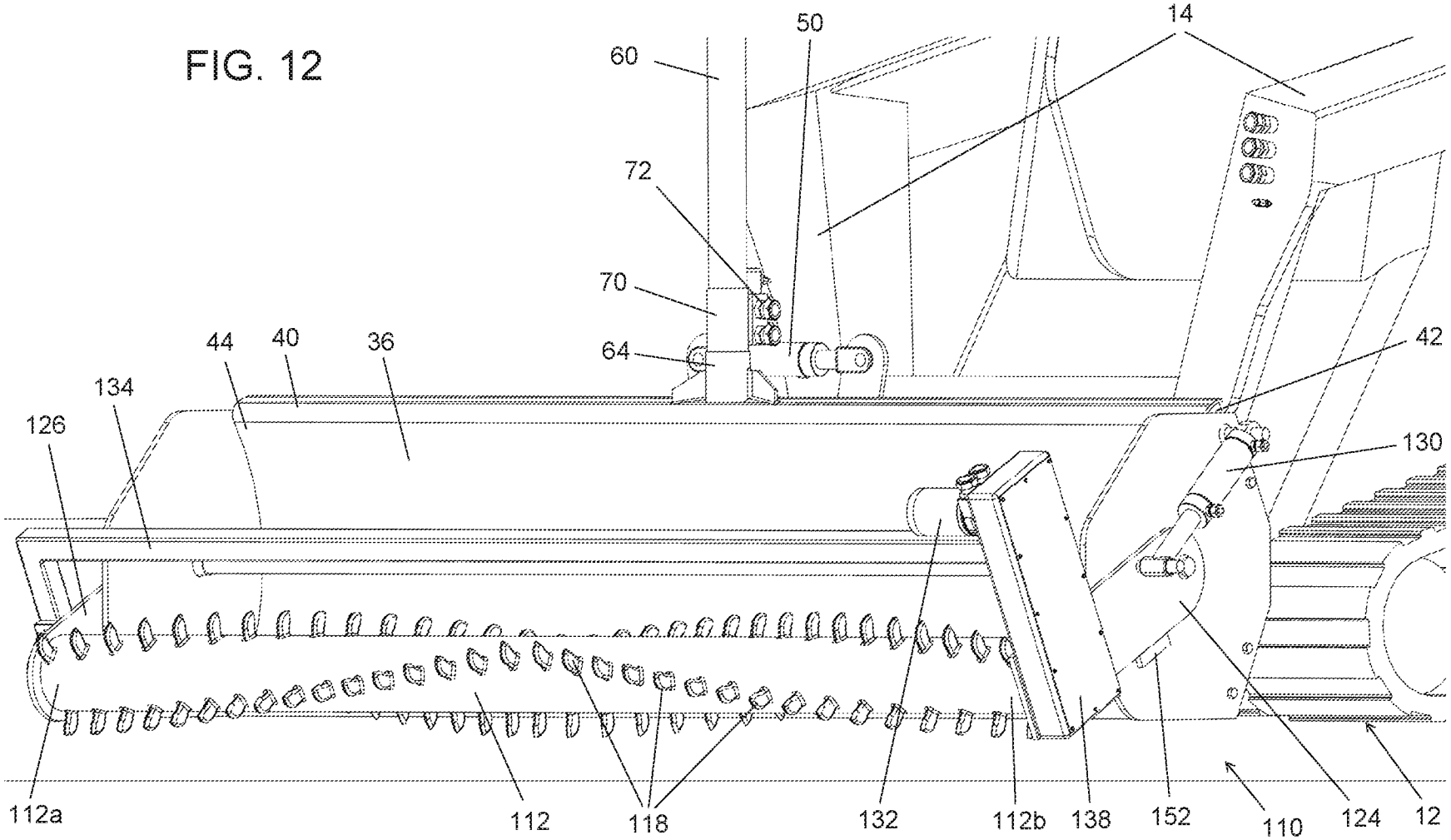
FIG. 12 is a left front perspective view of the example grading system shown in FIG. 1, with the grading blade assembly in a lowered position and the cutting element assembly at a position just below the ground surface on which the vehicle rests.

In FIG. 9B, the vehicle 12 is resting on the ground surface, the vertically movable arms 14 of the vehicle 12 have been moved to a lowermost position, while the mounting plates 32, 94 remain in a full overlap, resulting in the blade 34 of the grading blade assembly 20 being below the vehicle 20. In FIG. 9C, the vehicle 12 is resting on the ground surface, the vertically movable arms 14 of the vehicle 12 have been moved to a lowermost position, and the adjustable mounting of rearward facing mounting plate 32 is offset downward one half relative to the forward facing mounting plate 94, resulting in the grading blade assembly being further below the vehicle than in FIG. 9B. By comparison, FIG. 9D shows a more extreme raised position when the vehicle 12 is resting on the ground surface, the vertically movable arms 14 of the vehicle have been raised further than in FIG. 9A, and the adjustable mounting of rearward facing mounting plate 32 is offset upward one half relative to the forward facing mounting plate 94, resulting in the blade 34 of the grading blade assembly 20 being well above ground surface. It will be appreciated that the positions shown are merely some of the relative positions attainable, based on the range of offset available between the mounting plates 32, 94 and the extent to which the vertically movable arms 14 of the vehicle 12 can be lowered or raised from an initial mounting position that has the arms 14 raised above a lower most position. This also permits greater variation in digging and an ability to maintain the blade 34 at a relatively level position throughout a fairly large range of displacement in elevation, as the first pivot 24 remains substantially vertical. It also will be appreciated that the first pivot 24 will remain substantially vertical during such height adjustments, thus keeping the blade 34 level, even when introducing yaw movements, such as when turning the blade 34 left to right.

Relative to prior art grading systems, the more rigid connection and shorter extension of the grading system 10 from the front of the vehicle, while maintaining the blade 34 in a level position throughout its use at varied heights, permit one to more easily achieve the aforementioned goal in fine grading of finishing within ⅜" or ½" of the site plan, with as little waste as possible. In fact, by eliminating the shortcomings of the prior art systems, the present grading system 10 is able to achieve substantially better performance and to finish within ⅛" to ⅜" of a site plan.

Figure 13:
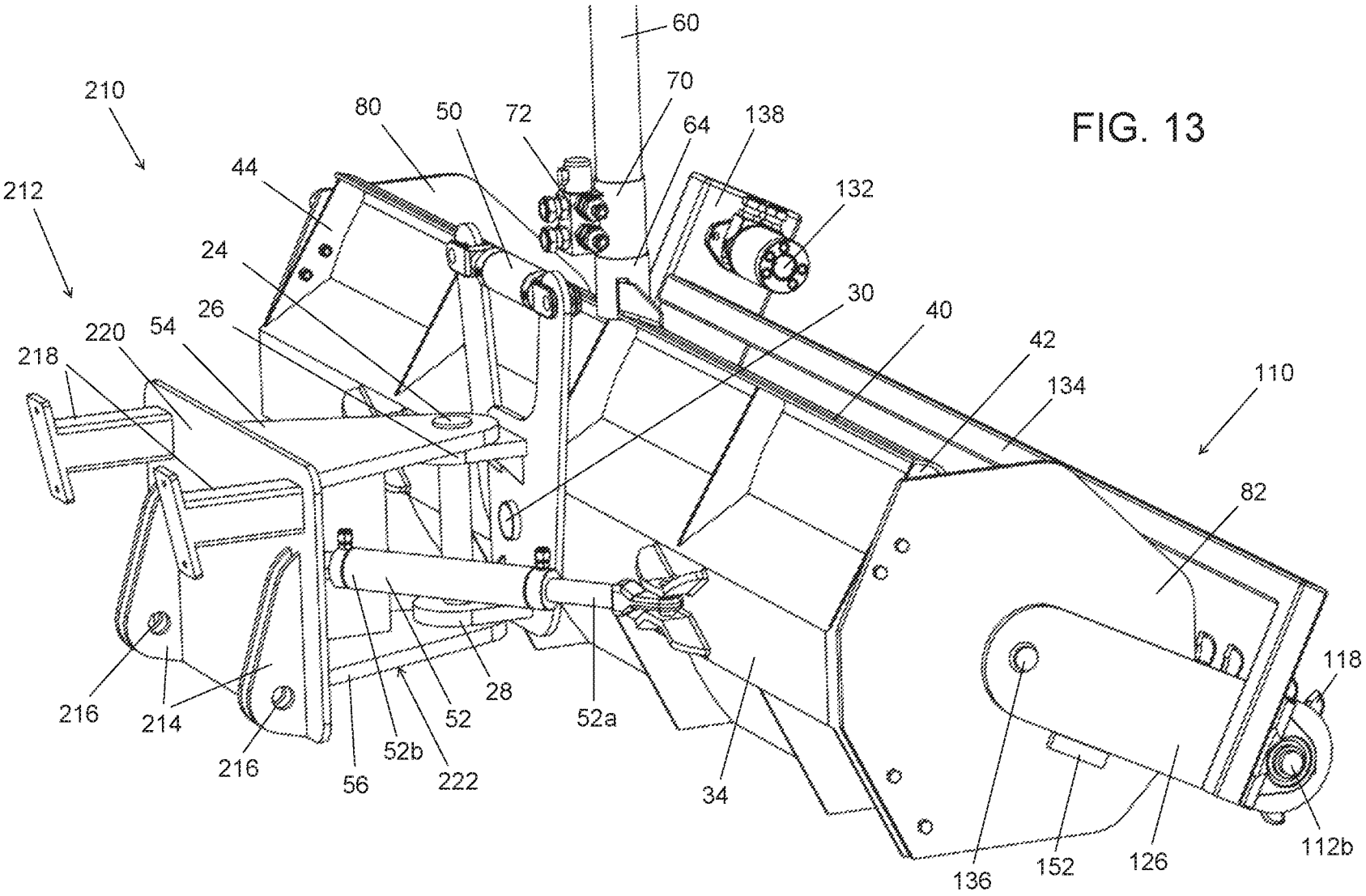
FIG. 13 is a right rear perspective view of a second example grading system having an integrated mounting interface for direct connection to a vehicle.

The second example grading system 210 shown in FIG. 13 presents an alternative mounting assembly 212 that includes brackets 214 and 218 extending rearward from a rearward facing mounting plate 220. The rearward facing mounting plate 220 is part of a frame 222 that otherwise includes the same components as in the first example grading system 10. Thus, the rearward facing mounting plate 220 is connected to the upper member 26 and lower member 28, such as by having an upper extension member 54 and a lower extension member 56 that extend forward from the rearward facing mounting plate 220 and are connected to the upper member 26 and lower member 28 via the first pivot 24. However, the mounting assembly 212 is constructed and configured for direct mounting to the vertically movable arms 14 of a vehicle 12. This is achieved by having rearward extending lower brackets 214 having passages 216 therethrough to accept pins 224 for connection to the end of the arms 14 of the vehicle 12, and rearward extending upper brackets 218 that are used to fix the position of the frame 222 of the grading system 210 directly to the vertically movable arms 14 of the vehicle 12, such as at a cross member. In this example, the connection of the rearward extending upper brackets 218 is accomplished by use of fasteners in the form of large U-shaped bolts with corresponding washers and nuts, similarly to those shown for the first example.

It will be appreciated that alternative configurations and structures may be used to form a suitable mounting assembly to provide for secure mounting of the grading system 210 directly to a vehicle 12 and the actual configuration likely will differ depending on the particular structure of the vehicle to which the grading system is to be mounted. Also, as with the first example, the mounting assembly 212 of the second example is adjustable with respect to the angle of the rearward facing mounting plate 220, such as by use of shims when connecting the rearward extending upper brackets 218 to the front arms of a vehicle, which may, for example, be in the same way as was shown for the first example, or the connection may be made in an alternative suitable manner.

Given the disclosure herein, it will be understood that the grading system 10 of the first example, and the grading system 210 of the second example, also may include an optional cutting element assembly 110. The cutting element assembly 110 is ideally suited for use with the grading blade assembly 20, but it will be understood that the cutting element assembly 110 alternatively could be used on other grading blade assemblies to overcome the aforementioned issues relating to hard or solid ground and debris.

The cutting element assembly 110 of the grading system 10 includes a rotor 112 having opposed ends 112*a*, 112*b*, and cutting teeth 118 connected to the rotor 112. The cutting teeth 118 preferably have respective cutting edges 120 at an angle relative to an outer surface 122 of the rotor 112, so as to provide cutting in one rotational direction. The cutting element assembly 110 additionally has first and second arms 124, 126, respectively, with each having a distal end 124*a*, 126*a*, respectively, rotatably connected to one of the respective opposed ends 112*a*, 112*b* of the rotor 112, and a proximal end 124*b*, 126*b*, respectively, pivotally connected to one of the respective end walls 80, 82 that extends forward from the opposed ends 42, 44 of the blade 34. At least one lift actuator 130 has a first end 130*a* pivotally connected to at least one of the first and second arms 124, 126 at a location spaced from the pivotal connection of the arm 124, 126 to the respective end wall 80, 82, and having a second end 130*b* pivotally connected to the grading blade assembly 20. In this example, one lift actuator 130 is connected to the arm 124 and to the end wall 80. The at least one lift actuator 130 enables the arms 124, 126 of the cutting element assembly 110 to have at least one lowered position and at least one raised position. In the example shown, the at least one lowered position may, for example, be identified as when the arms 124, 126 lower the rotor 112 to engage the ground surface, and at least one raised position may, for example, be identified as when the arms 124, 126 raise the rotor 112 and are pivoted to the furthest extent rearward, so as not to require lifting force from the lift actuator 130. It will be appreciated that the arms 124, 126 may have numerous raised positions within the pivotal range from a lowermost position that may extend below the ground surface, depending on the height of the grading blade assembly 20, to the extreme highest position noted as when the rotor 112 is pivoted to the furthest extent rearward. The cutting element assembly 110 also includes a drive motor 132 rotatably coupled to the rotor 112.

The example grading system 10 is shown with a stabilizing member 134 extending between and fixedly connected to the respective arms 124, 126. It will be appreciated that the stabilizing member 134 may be of tubular or solid construction, but is intended to provide additional structure to assist in keeping the arms 124 and 126 in registration with each other, so as to stay parallel with respect to the distance between the points along the arms, as well as with respect to their pivotal position. One other aspect of the present example that is used to keep the arms 124, 126 in registration with each other is that the pivotal connection of the proximal ends 124*b*, 126*b* of the arms 124, 126 to the respective end walls 80, 82 includes a drive shaft 136 fixedly connected to the proximal ends 124*b*, 126*b* of the arms 124, 126 and rotatably connected to the end walls 80, 82, respectively. As with the stabilizing member 134 it will be appreciated that the drive shaft 136 may be of tubular or solid construction. The drive shaft 136 being fixedly connected to the proximal ends 124*b*, 126*b* of the arms 124, 126 ensures that an input for rotational movement by the lift actuator 130 to the arm 124 will be transmitted to and cause a similar rotational movement of the other arm 126. As an alternative to use of the drive shaft 136, each arm 124, 126 could be separately connected to a lift actuator for independent but coordinated simultaneous movement.

The cutting teeth 118 may be fixedly connected to the rotor 112 by welding, or by use of individual holding devices for removable mounting of the teeth. Such individual holding devices also may be adjustable, to compensate with wear of the teeth over time. It is preferable that the cutting teeth 118 be very durable, so as to avoid constant replacement or adjustment, and as such, the cutting teeth 118 may be constructed of foundation welding bar cutting teeth. Thus, it is preferable that the cutting teeth 118 may be suitable for use on a cold planar to strip asphalt or concrete pavement, because this would provide for more aggressive cutting and greater durability. However, it will be appreciated that alternative teeth constructions may be used. It also will be appreciated that the rotor 112 may be driven in only one rotational direction, but alternatively could be configured to rotate in both forward and rearward directions. The particular cutting teeth 118 shown in the first example would provide for more aggressive cutting in one direction, and if configured to rotate in the opposite direction, would provide more of a raking effect.

The cutting teeth 118 also preferably are connected to the rotor 112 in a non-linear pattern. This may be seen in the example grading system 10 where the cutting teeth 118 may be said to be in a curve linear pattern across the outer surface 122 of the rotor 112. This configuration provides a further advantage of the example cutting element assembly 110 because it helps to reduce the torque required to rotate the rotor 112 when cutting into the hard ground surface by permitting only a few cutting teeth 118 to be in the same ground engaging position relative to each other across the length of the rotor 112. This is beneficial relative to cutting teeth being placed in linear rows arranged to extend longitudinally along the rotor 112. The non-linear pattern helps to maintain a more consistent number of teeth in engagement with the ground, and therefore, a more consistent level of torque required during cutting and mulching of the varied material encountered.

Figure 4:
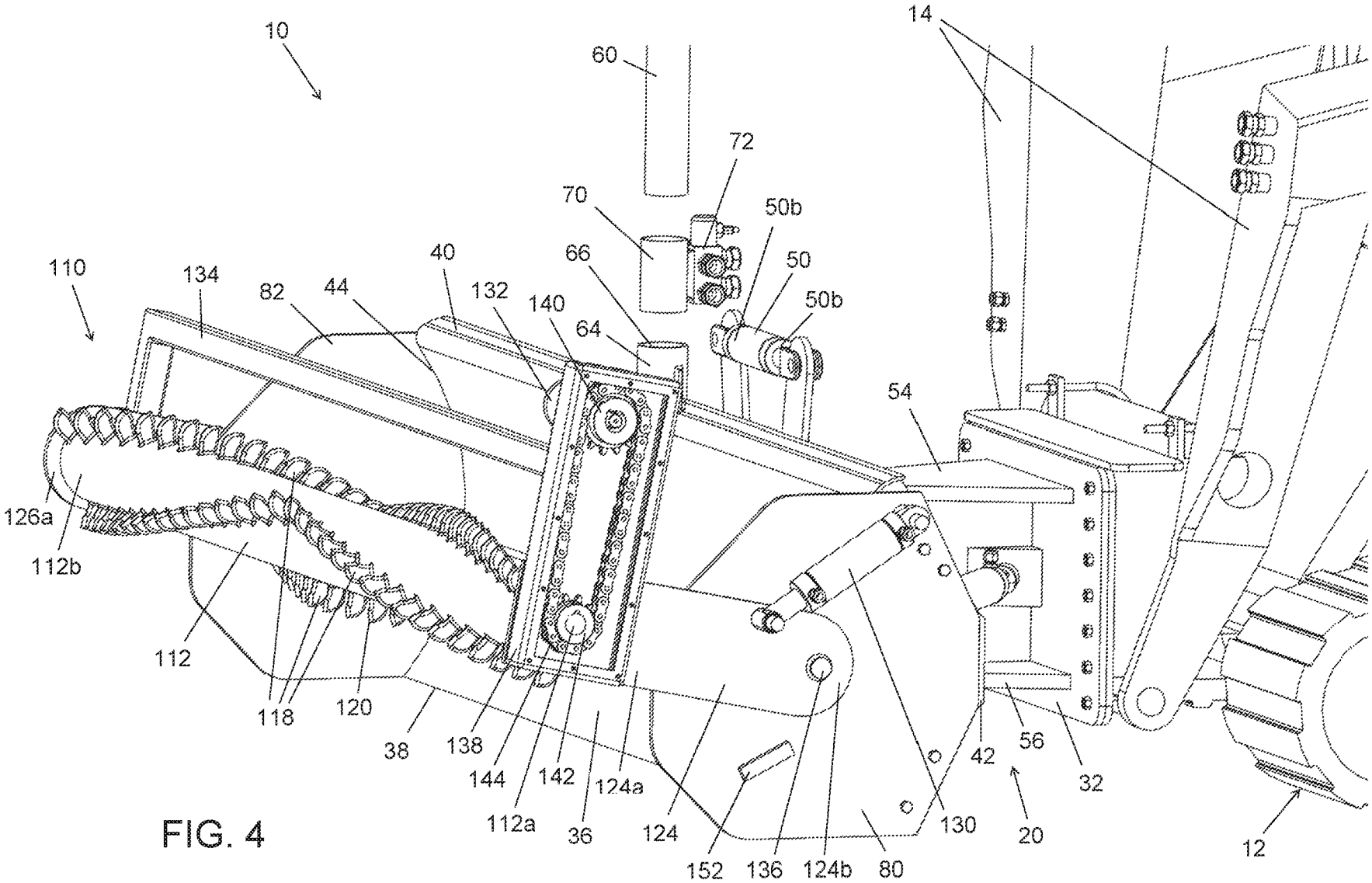
FIG. 4 is a closer left perspective view of the grading blade assembly of the example grading system shown in FIG. 1, with the drive system for the cutting element assembly exposed, mast mounting partially exploded, and the cutting element assembly in an intermediate raised position.

While the rotor 112 is driven by the drive motor 132, it will be appreciated that there are alternative ways of achieving this. For instance, as best seen in FIG. 4, the present example includes a transmission housing 138 that encloses a drive sprocket 140 on the drive motor 132, a driven sprocket 142 on an end 112*a* of the rotor 112, and a roller chain 144 coupling the drive sprocket 140 to the driven sprocket 142. Use of a hydraulic drive motor and the example configuration for transmission of power provides a reliable drive system for the rotor 112. However, it will be appreciated that alternative drive motors and/or transmission systems may be used to couple a drive force to the rotor. For instance, the rotor may be driven directly, by a hydraulic or electric motor. A further alternative may utilize different structures to couple the driving force to the rotor, such as a gear train or other torque altering gear or sprocket configurations, or other drive systems as desired.

As noted previously, it may be desirable to have the rotor 112 driven by the drive motor 132 in one rotational direction. If this is desired and a hydraulic motor is used as the drive motor 132, then the connection of the drive motor 132 to a hydraulic circuit optionally may include a one-way bypass valve 146 between a fluid input 148 and a fluid outlet 150, as best seen in FIG. 2. Especially when using a system that will only be rotating in one direction, the ability to permit hydraulic fluid flow to bypass the motor 132 can help to avoid shocks to the drive components that otherwise may occur when suddenly stopping or reversing fluid flow. Thus, the fluid flow necessary to drive the drive motor 132 may simply be diverted via the bypass valve 146, so as to permit the drive motor 132 to simply freely come to a stop.

It will be appreciated that, as described above, the grading system 10 may include a mast 60 that is connected to and extends upward from the grading blade assembly 20, and may include an electronic component 62 of an automated grade control system connected to the mast 60. The grading system 10 permits positions of the grading blade assembly 20 and positions of the cutting element assembly 110 each to be subject to an automated grade control system.

To control the potential depth of the cutting achieved with the cutting element assembly 110 in a fully lowered position, the end walls 80, 82 of the grading blade assembly 20 may include pivot limiters 152 for the arms 124, 126. Thus, the use of pivot limiters 152 can be very beneficial in that the lift actuator 130 may move the arms 124, 126 to a lowered position and does not have to apply a continuous lifting force, but rather can set the arms 124, 126 on the pivot limiters 152. While the weight of the cutting element assembly 110 may be sufficient to keep the arms 124, 126 engaged with the respective pivot limiters 152, to the extent necessary, the lift actuator 130 may apply a downward force to hold the arms 124, 126 against the pivot limiters 152. In addition, in order to account for the wear of the cutting teeth 118 or to make a fine adjustment in positioning, it is preferable that the pivot limiters 152 include adjustable stackable stops 154. As shown partially exploded in FIG. 2, the adjustable stops 154 optionally may include multiple shims held by a fastener, or alternative suitable constructions that provide for different selected heights of the pivot limiters 152, which may provide for position adjustment of the rotor 112 at its lowest position relative to the bottom of the end walls 80, 82 and bottom edge 38 of the blade 34.

From the above disclosure, it will be apparent that a grading system constructed in accordance with this disclosure may include a number of structural aspects that provide advantages over prior art grading systems for use on vehicles, depending upon the specific design chosen.

It will be appreciated that a grading system may have a grading blade assembly, a cutting element assembly, or both a grading blade assembly and a cutting element assembly consistent with this disclosure, and each assembly may be embodied in various configurations. Any variety of suitable materials of construction, configurations, shapes and sizes for the components and methods of connecting the components may be utilized to meet the particular needs and requirements of an end user. It will be apparent to those skilled in the art that various modifications can be made in the design and construction of such a grading system without departing from the scope or spirit of the claimed subject matter, and that the claims are not limited to the preferred embodiment illustrated herein.

The invention claimed is:

1. A grading system for connection to a vehicle having vertically movable arms comprising:

a grading blade assembly comprising:

a frame including a first pivot extending upward between an upper member and a lower member, a second pivot extending forward between the upper member and the lower member, and a rearward facing mounting plate connected to the upper member and to the lower member;

a blade comprising a forward facing blade body having a lower edge, an upper edge and opposed ends, wherein the blade is connected to the frame via the first pivot and the second pivot;

a blade yaw actuator connected to the frame and to the blade, wherein the blade yaw actuator adjusts yaw movement of the blade relative to the first pivot;

a blade roll actuator connected to the frame and to the blade, wherein the blade roll actuator adjusts roll movement of the blade relative to the second pivot;

wherein the frame is configured to have the first pivot extend substantially vertically and the second pivot extend substantially longitudinally when the grading blade assembly is connected to the vehicle and the blade and vehicle are in a level position on a ground surface and the vertically movable arms of the vehicle are in a first raised position above a lowest most position;

wherein the grading blade assembly further comprises end walls that are connected to and extend forward from the respective opposed ends of the blade; and a cutting element assembly comprising:

a rotor having opposed ends;

cutting teeth connected to the rotor and having respective cutting edges at an angle relative to an outer surface of the rotor so as to provide cutting in one rotational direction;

first and second arms each having a distal end rotatably connected to one of the respective opposed ends of the rotor and a proximal end pivotally connected to one of the respective end walls that extend forward from the opposed ends of the blade;

at least one lift actuator having a first end pivotally connected to at least one of the first and second arms at a location spaced from the pivotal connection of the arm to the respective end wall and having a second end pivotally connected to the grading blade assembly, wherein the arms of the cutting element assembly have at least one lowered position and at least one raised position; and a drive motor rotatably coupled to the rotor.

2. The grading system of claim 1, wherein the blade yaw actuator and blade roll actuator are hydraulic actuators.

3. The grading system of claim 1, wherein the blade yaw actuator is connected at a first end to the blade at a location spaced laterally from the first pivot toward one of the ends of the blade and connected at a second end to the frame at a location rearward of the first pivot.

4. The grading system of claim 1, further comprising a second blade yaw actuator connected at a first end to the blade at a location spaced laterally from the first pivot toward one of the ends of the blade and connected at a second end to the frame at a location rearward of the first pivot.

5. The grading system of claim 1, wherein the blade roll actuator is connected at a first end to the blade at a location spaced laterally from the first pivot toward one of the ends of the blade and connected at a second end to the frame at a location spaced vertically from the second pivot.

6. The grading system of claim 1, wherein the grading system rearward facing blade has a pre-selected pitch position that remains substantially the same within the normal range of movement of the vertically movable arms of the vehicle during grading.

7. The grading system of claim 1, wherein the frame further comprises an upper extension member and a lower extension member that extend forward from the rearward facing mounting plate that are connected to the upper member and lower member via the first pivot.

8. A grading system for connection to a vehicle having vertically movable arms comprising:

a grading blade assembly comprising:

a frame including a first pivot extending upward between an upper member and a lower member, a second pivot extending forward between the upper member and the lower member, and a rearward facing mounting plate connected to the upper member and to the lower member;

a blade comprising a forward facing blade body having a lower edge, an upper edge and opposed ends, wherein the blade is connected to the frame via the first pivot and the second pivot;

a blade yaw actuator connected to the frame and to the blade, wherein the blade yaw actuator adjusts yaw movement of the blade relative to the first pivot;

a blade roll actuator connected to the frame and to the blade, wherein the blade roll actuator adjusts roll movement of the blade relative to the second pivot;

wherein the frame is configured to have the first pivot extend substantially vertically and the second pivot extend substantially longitudinally when the grading blade assembly is connected to the vehicle and the blade and vehicle are in a level position on a ground surface and the vertically movable arms of the vehicle are in a first raised position above a lowest most position; and a mast that is connected to and extends upward from the grading blade assembly and a collar rotatably connected to the mast.

9. The grading system of claim 8, wherein at least one hydraulic component is connected to the collar and remains in a substantially longitudinal direction when the blade is subjected to a yaw movement.

10. The grading system of claim 9, wherein the at least one hydraulic component is a valve body that includes a first circuit that controls the blade roll actuator and a second circuit that controls the blade yaw actuator.

11. The grading system of claim 1, further comprising a mounting assembly that connects the frame to the vehicle.

12. The grading system of claim 11, wherein the mounting assembly further comprises a mounting interface that connects to the vehicle and includes a forward facing mounting plate.

13. The grading system of claim 12, wherein the mounting interface is adjustable with respect to the angle of the forward facing mounting plate.

14. The grading system of claim 12, wherein the rearward facing mounting plate of the frame is height adjustable relative to the forward facing mounting plate of the mounting interface.

15. The grading system of claim 11, wherein the mounting assembly further comprises brackets extending rearward from the rearward facing mounting plate of the frame and fasteners that connect the brackets directly to the vehicle.

16. The grading system of claim 1, wherein the end walls of the grading blade assembly include forward extensions that are adjustable with respect to extending forward from the blade.

17. The grading system of claim 1, wherein the end walls of the grading blade assembly include downward extensions that are adjustable with respect to extending downward from the blade.

18. The grading system of claim 1, further comprising a stabilizing member extending between and fixedly connected to the respective arms.

19. The grading system of claim 8, further comprising an electronic component of an automated grade control system connected to the mast.

20. The grading system of claim 8, further comprising a mast receiver connected to the grading blade assembly and configured to removably receive the mast.

* * * * *